US011266899B2

(12) United States Patent
Pellegrinetti

(10) Patent No.: US 11,266,899 B2
(45) Date of Patent: Mar. 8, 2022

(54) COUPLING ASSEMBLY BETWEEN A FOOTWEAR AND A SPORT EQUIPMENT SUCH AS A SKI OR A SNOWBOARD

(71) Applicant: Stefano Pellegrinetti, Pietrasanta (IT)

(72) Inventor: Stefano Pellegrinetti, Pietrasanta (IT)

( * ) Notice: Subject to any disclaimer, the term of this patent is extended or adjusted under 35 U.S.C. 154(b) by 0 days.

(21) Appl. No.: 16/598,276

(22) Filed: Oct. 10, 2019

(65) Prior Publication Data

US 2020/0114250 A1 Apr. 16, 2020

(30) Foreign Application Priority Data

Oct. 11, 2018 (IT) ..... 102018000009359

(51) Int. Cl.

| | |
|---|---|
| ***A63C 10/08*** | (2012.01) |
| ***A63C 10/10*** | (2012.01) |
| ***A63C 10/14*** | (2012.01) |
| ***A63C 10/28*** | (2012.01) |

(52) U.S. Cl.

CPC ..... *A63C 10/08* (2013.01); *A63C 10/106* (2013.01); *A63C 10/14* (2013.01); *A63C 10/28* (2013.01)

(58) Field of Classification Search

CPC ..... A63C 10/08; A63C 10/106; A63C 10/14; A63C 10/28

See application file for complete search history.

(56) References Cited

U.S. PATENT DOCUMENTS

| | | | | |
|---|---|---|---|---|
| 3,318,610 A | | 5/1967 | Kulick | |
| 5,085,453 A | * | 2/1992 | Bildner | A63C 9/005 280/612 |
| 5,743,550 A | * | 4/1998 | Frohwein | A63C 9/0802 280/612 |
| 5,769,438 A | | 6/1998 | Svetlov | |
| 6,007,086 A | * | 12/1999 | Hopkins | A63C 9/0802 280/612 |
| 2003/0047910 A1 | * | 3/2003 | Golling | A63C 10/106 280/612 |
| 2003/0075890 A1 | | 4/2003 | Jacobs | |
| 2007/0080518 A1 | * | 4/2007 | Carvajal | A63C 10/12 280/611 |
| 2007/0090627 A1 | * | 4/2007 | Laurent | A63C 9/088 280/612 |
| 2009/0288316 A1 | * | 11/2009 | Fullerton | A43B 5/08 36/116 |
| 2010/0059969 A1 | * | 3/2010 | Scharman | A63C 10/28 280/612 |
| 2011/0079986 A1 | * | 4/2011 | Gradman | A63C 5/03 280/609 |

(Continued)

FOREIGN PATENT DOCUMENTS

| | | |
|---|---|---|
| WO | 8203183 A1 | 9/1982 |

*Primary Examiner* — James A Shriver, II

*Assistant Examiner* — Michael T. Walsh

(74) *Attorney, Agent, or Firm* — Cantor Colburn LLP

(57) ABSTRACT

Coupling assembly between a footwear and a sport equipment comprising at least one housing on the footwear near the sole suitable for receiving a first metallic element, a binding, on the sport equipment, provided with a seat for the insertion of the footwear, the binding being equipped with at least a second metallic element positioned in the seat, the first or the second metal element being an electromagnet, which when activated is magnetically bound to the other element.

9 Claims, 1 Drawing Sheet

(56) References Cited

U.S. PATENT DOCUMENTS

| | | | | |
|---|---|---|---|---|
| 2012/0211969 | A1* | 8/2012 | Walker | A63C 10/145<br>280/623 |
| 2013/0328288 | A1* | 12/2013 | Smith | A63C 10/24<br>280/617 |
| 2014/0042728 | A1* | 2/2014 | Noyes | A63C 10/18<br>280/612 |
| 2015/0238844 | A1* | 8/2015 | Walker | A63C 10/14<br>280/14.22 |
| 2018/0264347 | A1* | 9/2018 | Tran | A63B 71/145 |

* cited by examiner

COUPLING ASSEMBLY BETWEEN A FOOTWEAR AND A SPORT EQUIPMENT SUCH AS A SKI OR A SNOWBOARD

TECHNICAL FIELD

The present disclosure relates to a coupling assembly between a footwear and a sport equipment which exploits magnetic elements.

BACKGROUND

Examples of this sport equipment can be for example skis, snowboards or water skis, surfboards, windsurf or kitesurf boards, bicycles and generally all sport equipment that needs to be bound to the user's feet.

In the winter sports field, the bindings fixing the boot to the skis or to the snowboard are essentially mechanisms of the mechanical type which use interlocks and springs to ensure a stable binding, which must however be able to be released in the event of a danger to the user.

For example, for a snowboard the boot is fixed to the board, by a binding, fixed to the board in which the boot is fitted, with the aid of ratchets, operated manually by the user, and is bound to the snowboard.

Similarly for a ski, the boot is inserted into a binding on the ski and which determines a housing for the boot. The stable binding is generated by exerting pressure with the boot on the ski, which determines the locking of a snap-on mechanism present in the binding. To release the boot from the ski generally on the binding there is a sort of button, which can be advantageously pressed with the aid of a ski pole, which determines the release of the snap-on mechanism.

These are generally quite complex mechanisms, and which in any case always require a manual operation to both bind the boot to the equipment and subsequently to release it.

BRIEF SUMMARY

The present disclosure sets out to overcome the aforesaid drawbacks, linked to both the mechanical conformation of the bindings and the difficulty in manually operating them, by realizing a coupling assembly between a footwear and a sport equipment that uses magnetic elements to ensure the binding and releasing. In this way the footwear is hooked onto the equipment in a quick and safe manner, without any awkward movements for the user.

One aspect of the present disclosure regards a coupling assembly between a footwear and a sport equipment.

BRIEF DESCRIPTION OF THE DRAWINGS

The characteristics and advantages of the present disclosure will be clearer and evident from the following illustrative and non-limiting description of an embodiment, which regards a coupling assembly between a boot and a snowboard, with reference to the attached figures.

In an equivalent manner the present disclosure can be applied to boots and skis and other sport equipment.

These figures illustrate respectively:

FIG. 1 represents a side view of a boot of the coupling assembly according to the present disclosure;

FIG. 2 represents a perspective view of the coupling assembly according to the present disclosure;

Figure 1:
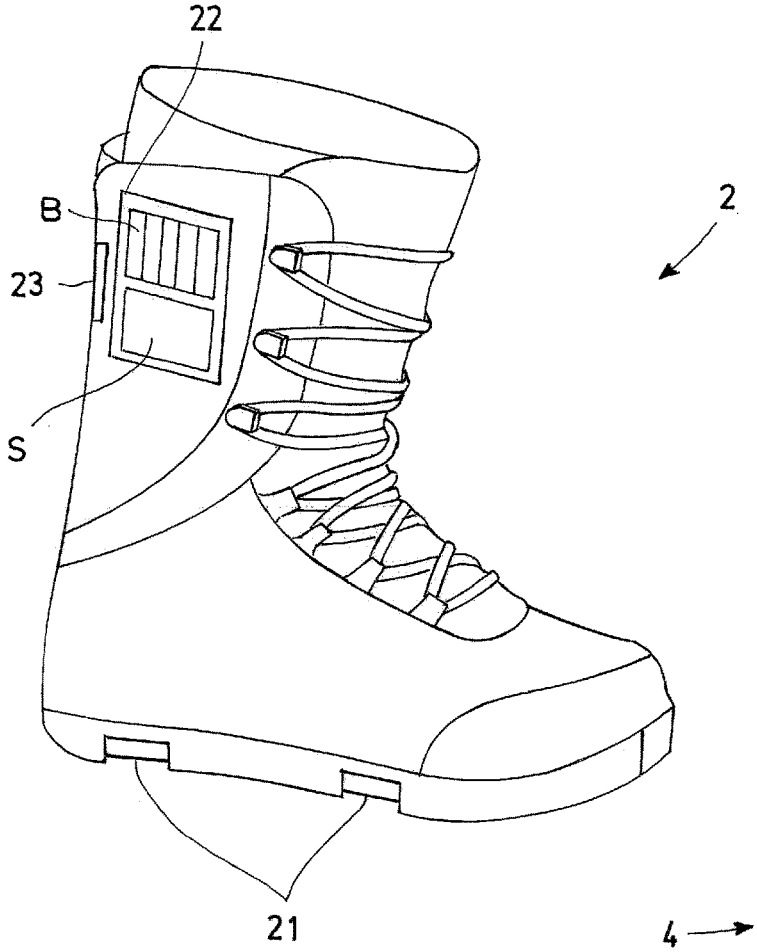
Figure 3:
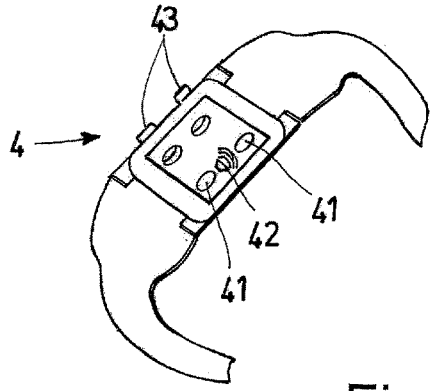
Figure 2:
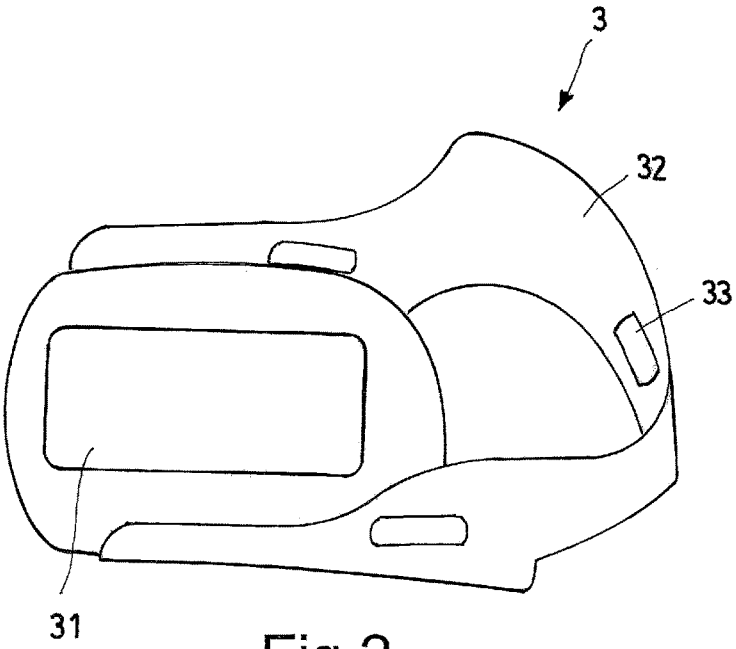

FIG. 3 schematically illustrates a control bracelet of the coupling assembly according to the present disclosure.

DETAILED DESCRIPTION

With reference to the cited figures, the coupling assembly according to the present disclosure comprises a footwear 2, in the embodiment illustrated conformed like a boot, comprising at least one housing near the sole suitable for receiving a first metallic element 21 and a binding 3 fixed on the sport equipment, provided with a seat for the insertion of said footwear, also equipped with at least a second metallic element 31. Alternatively, the first 21 or the second 31 metallic element is an electromagnet, which when activated is magnetically bound to the other element 31 or 21.

For the purpose of the present disclosure, electromagnet means a metallic element to which electrical energy is supplied, for example by means of a conductor wire coil which acts as a magnet when the said electric current passes through it, but which stops being a magnet when the current stops.

The positioning of the first metallic element on the footwear and the second metallic element in the binding is such that it places the two metallic elements at a minimum distance, substantially in contact, when the footwear is placed on the binding, so as to allow the magnetic field generated by the electromagnetic metallic element to interact in an optimal way on the other.

Therefore, when the electromagnet is activated and the footwear is placed in the housing the footwear is bound stably to the equipment.

The metallic elements are preferably plate-shaped, so that they can better be coupled together. Preferably, the electromagnet is the first metallic element, namely the one inserted in the sole of the footwear, which also supports at least one compartment 22 to house one or more power supply batteries B of said electromagnet and one electronic microprocessor board S for controlling the assembly.

Preferably, there are two first metallic elements 21, one positioned near the tip and one near the heel of the footwear.

The binding 3 provides two magnetic elements 31 located in correspondence of those provided on the boot in order to perfectly mate each other.

Alternatively on the binding a single plate is provided.

According to an alternative embodiment, the electromagnet is the second metallic element 31, the one provided on the sport equipment binding, on said binding being also housed the battery and the electronic control board.

Furthermore, the coupling assembly comprises an electronic control interface 4, connectable in wireless mode (for example via BLUETOOTH® wireless technology) to said electronic board, which may be in the form of a bracelet, a portable electronic device such as for example a smartphone, or a smartwatch, which is provided with suitable buttons, or similar control elements of the electromagnets and generally speaking of the electronic board.

The assembly is also provided with a proximity sensor monitored constantly by said electronic board which allows the electronic board to understand when the footwear is properly positioned, so as to allow the passage of the power supply for the electromagnets. Among other things, this prevents the circuit from being activated incorrectly outside the binding, preventing an unnecessary waste of the batteries.

In the illustrated embodiment the footwear is a boot and the sport equipment is a snowboard.

A rear buckle 32 houses the rear part of the boot, facilitating the fit. Said buckle 32 is also used to position an abutment element 33 for the proximity sensor 23 located in the rear part of the boot. This abutment element 33 may advantageously be a magnet.

The electronic board mainly controls the activation of the electromagnets, and also monitors the proximity sensor and the batteries, communicating with the coupling interface to activate and monitor the boot hooking and unhooking.

According to a characteristic of the disclosure, the said board may be equipped with an electronic charging device, which exploits the movement of the boot or the equipment if the board is positioned on the same equipment. Inside said devices are provided with a series of coils and magnets, which with movement form an electromagnetic field around the said coils useful for generating electrical energy.

Said interface 4, illustrated by way of example in the form of a bracelet, is powered autonomously and is equipped with electronic controls to enable/disable the electromagnets and consequently hook/unhook the boot to/from the snowboard. Furthermore, it is equipped with LED lights 41 and an acoustic signalling device 42 useful for allowing the user to promptly monitor the operating status of the whole equipment.

For example, the magnetic hooking between the boots and the binding above the snowboard is therefore possible by means of a prolonged press (2-3 seconds) of a dedicated button 43 (preferably a button for each boot) which activates the power supply to the electromagnets.

To avoid accidents or pointless discomfort, as already described, a proximity sensor is fitted in the rear part of the boot which, when in the exact position on the magnet located on the frame of the binding, ensures that the microprocessor understands when the boot is in the correct position and allows the activation of the electromagnets.

Again for the purpose of guaranteeing the safety of the user, the footwear or sport equipment has a safety release device (i.e. a button) which at any time allows the user to free the footwear from the binding.

The invention claimed is:

1. Coupling assembly between a footwear, such as a shoe or a boot, and a sport equipment, comprising:

at least one housing, on said shoe, close to a sole suitable for receiving a first metallic element;

a binding, on said sport equipment, provided with a seat for insertion of said footwear, said binding being equipped with at least a second metallic element positioned in said seat, wherein the first or the second metal element is an electromagnet, which when activated is magnetically bound to the other element; and comprising a proximity sensor located in the rear part of the boot monitored by an electronic control board which allows the same electronic control board to understand when the footwear is properly positioned, so as to allow the passage of the power supply for the electromagnet.

2. Assembly according to claim 1, wherein said metallic elements are plate-shaped, so that they can better be coupled together.

3. Assembly according to claim 1, wherein the first metallic element, the one inserted in the sole of the footwear, is the electromagnet.

4. Assembly according to claim 3, wherein at least one compartment is provided on said footwear, suitable for housing one or more power supply batteries of said electromagnet and said electronic control board for controlling the electromagnets.

5. Assembly according to claim 3, wherein the first metallic elements are two, and are provided respectively one near a tip and one near a heel of the footwear and the binding provides two magnetic elements located in correspondence of those provided on the boot in order to perfectly mate each other.

6. Assembly according to claim 1, wherein the second metallic element, the one provided on the sport equipment binding, is the electromagnet, on said binding being also housed the battery and the electronic control board.

7. Assembly according to claim 1, comprising an electronic control interface, wireless communicating with said electronic control board and which is provided with suitable buttons, or similar control elements of the electromagnets and of the electronic control board.

8. Assembly according to claim 7, wherein said electronic control interface is an electronic bracelet or a portable electronic device comprising a smartphone or a smartwatch.

9. Assembly according to claim 1, wherein said footwear is a boot and said sport equipment is a snowboard.

* * * * *